US010773859B2

(12) United States Patent
Walters et al.

(10) Patent No.: US 10,773,859 B2
(45) Date of Patent: Sep. 15, 2020

(54) TUBE SQUEEZING DEVICE

(71) Applicants: Jerry Walters, Henderson, NV (US); Leslie Nielson, Henderson, NV (US)

(72) Inventors: Jerry Walters, Henderson, NV (US); Leslie Nielson, Henderson, NV (US)

( * ) Notice: Subject to any disclaimer, the term of this patent is extended or adjusted under 35 U.S.C. 154(b) by 0 days.

(21) Appl. No.: 16/531,217

(22) Filed: Aug. 5, 2019

(65) Prior Publication Data

US 2020/0047953 A1 Feb. 13, 2020

Related U.S. Application Data

(60) Provisional application No. 62/718,129, filed on Aug. 13, 2018.

(51) Int. Cl.
*B65D 35/28* (2006.01)
*B65D 35/56* (2006.01)
*A47K 5/122* (2006.01)

(52) U.S. Cl.
CPC ..... *B65D 35/28* (2013.01); *A47K 5/122* (2013.01); *B65D 35/56* (2013.01)

(58) Field of Classification Search
CPC .. B65D 35/28; B65D 35/56; B65D 2231/001; A47K 5/122
See application file for complete search history.

(56) References Cited

U.S. PATENT DOCUMENTS 1,242,165 A * 10/1917 Fitzgerald ..... B65D 35/28 222/103
2,413,323 A * 12/1946 Hills ..... B65D 35/02 222/107
3,262,605 A * 7/1966 Madden ..... B65D 35/28 222/103
4,750,647 A * 6/1988 Cohen ..... B65D 83/0061 137/859
6,561,385 B1 5/2003 Jacobs
6,719,169 B1 4/2004 Gandy
7,398,897 B1 7/2008 Walker
8,033,428 B1 10/2011 McEwin
(Continued)

FOREIGN PATENT DOCUMENTS

JP 01240454 A * 9/1989
JP 2013193749 A * 9/2013

*Primary Examiner* — David P Angwin
*Assistant Examiner* — Bob Zadeh
(74) *Attorney, Agent, or Firm* — Boudwin Intellectual Property; Daniel Boudwin

(57) ABSTRACT

A tube squeezing device. The tube squeezing device includes a body with a first member, a second member, an elastic material, a collar, and a fastener. An elastic material runs along the length of sides of each member and connects the first member to the second member. The collar connects the top end of the first member to the top end of the second member. The collar has an aperture sized to receive a neck of a container therethrough. The fastener on the bottom ends of the first and second members selectively secures the bottom ends together. In various embodiments, pins are pivotally attached to the bottom of the members and travel in grooves to selectively keep the device in an open or closed configuration. The tube squeezing device is utilized to receive a tube of material and enable a user to squeeze out the material.

9 Claims, 3 Drawing Sheets

(56) References Cited

U.S. PATENT DOCUMENTS

| | | | | |
|---|---|---|---|---|
| 2003/0192909 | A1* | 10/2003 | Maskell | B65D 35/28<br>222/103 |
| 2004/0232164 | A1 | 11/2004 | Bardeggia | |
| 2004/0238565 | A1* | 12/2004 | Turano | B65D 35/28<br>222/103 |
| 2014/0319173 | A1* | 10/2014 | Barlow | A45D 34/00<br>222/103 |
| 2017/0267413 | A1* | 9/2017 | Qian | B65D 35/28 |

* cited by examiner

TUBE SQUEEZING DEVICE

CROSS REFERENCE TO RELATED APPLICATIONS

This application claims the benefit of U.S. Provisional Application No. 62/718,129 filed on Aug. 13, 2018. The above identified patent application is herein incorporated by reference in its entirety to provide continuity of disclosure.

BACKGROUND OF THE INVENTION

The present invention relates to material dispensers. More particularly, the present invention provides for a tube squeezing device that is utilized to receive a tube of material and enable a user to squeeze the material out of the tube in a highly efficient manner, thereby enabling a user to maximize the amount of material able to be dispensed from said tube.

Many people buy lotions, toothpaste, sunscreen, and various other assorted materials in tubes. These tubes are typically one-piece construction with a dispensing end. Where a user squeezes the tube, the material is pushed out through the dispensing end. Initially, this manner of dispensing material does not pose an issue. However, as less and less material remains in the tube, it becomes increasingly harder and harder to squeeze out the material. Users are left trying to wring out the tube, or carefully roll the tube from the bottom in an effort to maximize the amount of material and minimize waste in the form of material left within the tube. This can be clumsy and lead to an unsightly mess as the tube becomes crumpled and disfigured.

Devices have been disclosed in the known art that relate to material dispensers. These include devices that have been patented and disclosed in patent application publications. However, the devices in the known art have several drawbacks. Some devices are wall-mounted and require the user to prime the device with material. These wall-mounted devices are not convenient and are not portable, thus they have no use outside the room in which they are installed. Other devices utilize clips or clamps to wring the tube. However, these devices are clumsy and do not address the problem of the unsightly mess that is left behind or that results from rolling or squeezing the tube in such a manner. The present invention substantially diverges in design elements from the known art and consequently it is clear that there is a need in the art for an improvement to existing material dispensing devices.

SUMMARY OF THE INVENTION

In view of the foregoing disadvantages inherent in the known types of material dispensing devices disclosed in the prior art, the present invention provides a tube squeezing device wherein the same can be utilized to receive a tube of material and enables a user to squeeze the material out of the tube in a highly efficient manner, thereby enabling a user to maximize the amount of material able to be dispensed from said tube. The present tube squeezing device comprises a body with a first member, a second member, an elastic material, a collar, and a fastener. An elastic material runs along the length of sides of each the member and connects the first member to the second member. The collar connects the top end of the first member to the top end of the second member. The collar has an aperture sized to receive a neck of a container therethrough. The fastener on the bottom ends of the first and second members selectively secures the bottom ends together. In various embodiments, pins are pivotally attached to the bottom of the members and travel in grooves to selectively keep the device in an open or closed configuration.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
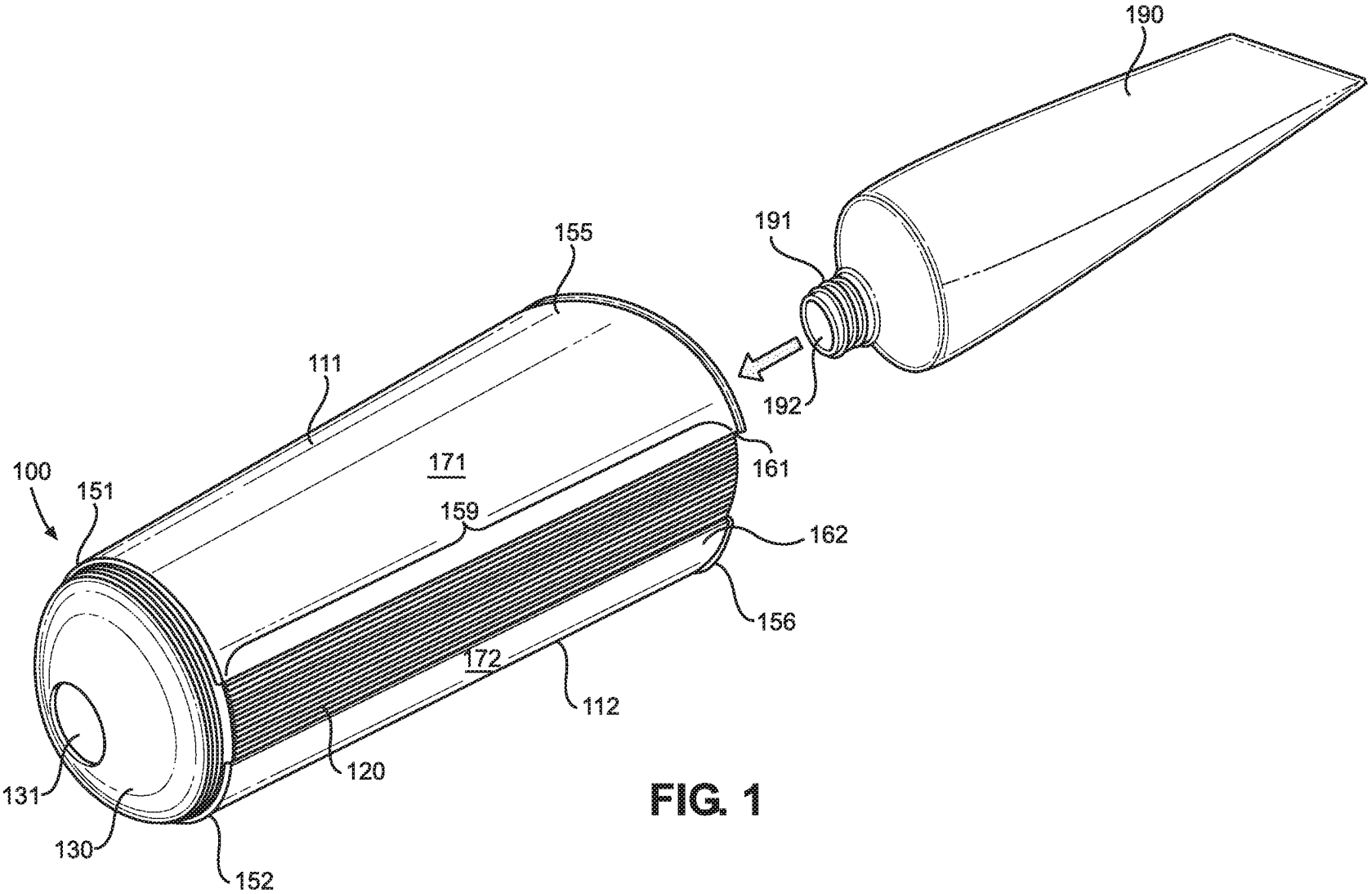
FIG. 1 shows a side view of an embodiment of the tube squeezing device.

Reference is made herein to the attached drawings. Like reference numerals are used throughout the drawings to depict like or similar elements of the tube squeezing device. For the purposes of presenting a brief and clear description of the present invention, a preferred embodiment will be discussed as used for the tube squeezing device. The figures are intended for representative purposes only and should not be considered to be limiting in any respect.

Referring now to FIG. 1, there is shown a side view of an embodiment of the tube squeezing device. The tube squeezing device comprises a body 100 having a first member 111, second member 112, an elastic material 120, a collar 130, and a fastener (as shown on FIG. 3, 400). The tube squeezing device is sized and shaped to accept and receive a tube 190 containing a desired material to be dispensed. The first member 111 and the second member 112 each have a top end 151, 152, and a bottom end 155, 156, an interior surface and an exterior surface 171, 172. In one embodiment, the first member 111 and the second member 112 are comprised of a flexible material. In another embodiment, the first member 111 and the second member 112 are comprised of a rigid material. In a further embodiment, the rigid material is a hard plastic. The flexible material provides the benefit of a pliable surface that absorbs shock where the tube squeezing device is dropped. The rigid material provides the benefit of translating more force that the user exerts on the device to the tube without having the force partially absorbed by a different type of material.

In one embodiment, the exterior surface 171, 172 of the first member 111 and the second member 112 are comprised of a waterproof material. The waterproof material enables a user to wash and clean the exterior of the tube squeezing device in order to provide an easy to clean surface. In such an embodiment, a user is able to place the device in a washing machine, such as a dishwasher, to clean it. An easy to clean surface is desirable to not only keep a clean aesthetic, but also to reduce the amount of accumulation of materials, such as dirt, germs, and excess material that may overflow from inside the tube 190, on the exterior surfaces 171, 172 of the device. The waterproof material prevents water from penetrating the exterior surfaces 171, 172 of the tube squeezing device and contaminating, or watering down, the materials inside the tube 190.

In one embodiment, a raised texture is disposed on the exterior surfaces 171, 172 of the first member 111 and the second member 112. The raised texture enables a user to have a better grip on the exterior surfaces 171, 172 of the tube squeezing device. In another embodiment, the first member 111 and the second member 112 are ergonomic and comprise contours to receive a human hand in a squeezing motion. In such a manner, the contours enable a user to maintain a comfortable grip on the exterior surfaces 171, 172 of the tube squeezing device, thereby providing a device more conducive to a squeezing motion of the user's hand.

In another embodiment, the first member 111 and the second member 112 further comprise a contour that mimics the contours of the tube 190 received therein. In this manner, the device is configured to encapsulate and closely surround the tube 190, thereby providing more surface area in contact with the tube 190. The greater surface area is desirable when the device is utilized to squeeze the tube 190 as the user is able to selectively squeeze the device at the corresponding part of the tube 190 in which the user chooses to exert force and thereby direct the material in the tube 190 through the neck 191 of the tube 190 and through the dispensing end 191 of the tube 190. In another embodiment, the first member 111 and the second member 112 each have an inward taper such that the bottom ends 155, 156 of the first member 111 and the second member 112 are wider than the top ends 151, 152 thereof. Such an inward taper allows for a closer mimicking of the tube 190 when the tube 190 includes such a taper in its design.

In the shown embodiment, an elastic material 120 connects a first side 161 of the first member 111 to a first side 162 of the second member 112. In the shown embodiment, a second elastic material 120 connects a second side of the first member 111 to a second side of the second member 112 (as further seen in FIG. 2, 261, 262.) In the shown embodiment, the elastic material 120 is disposed along a length 159 of the first and second sides 161, 261 of the first member 111 and a length 159 of the first and second sides 162, 262 of the second member 112. The elastic material 120 runs from the top end 151, 152 to the bottom end 155, 156 of each side. In one embodiment, the elastic material 120 is spandex. Spandex provides a strong material with elastic properties and ability to return to its original shape and orientation. In another embodiment, the elastic material 120 folds upon itself in an accordion fashion. This folding pattern provides a clean aesthetic and enables the material to gather in a small space and efficient manner when the device is in its closed configuration.

Figure 2:
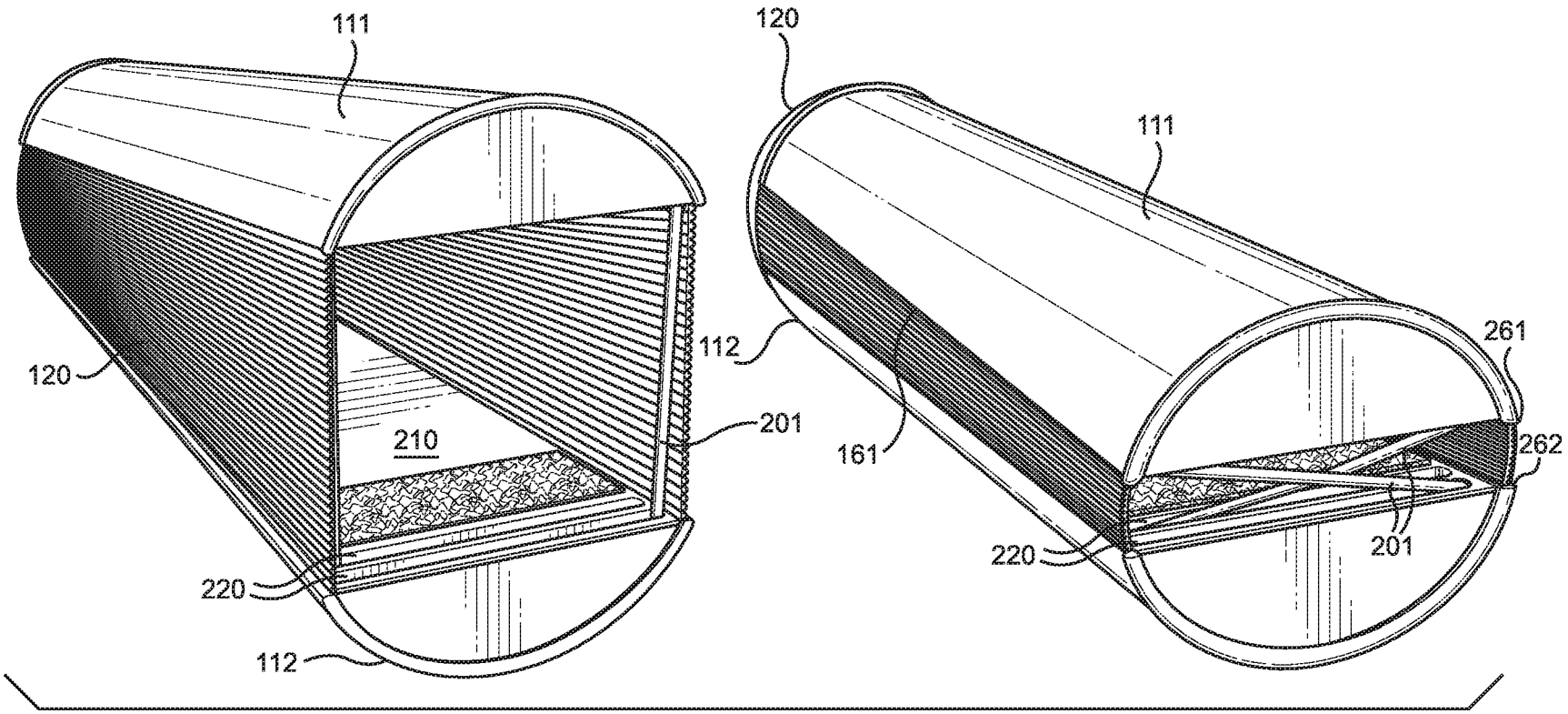
FIG. 2 shows a rear view of an embodiment of the tube squeezing device in an open and a partially closed configuration.

The interior surfaces of the first member 111 and the second member 112 are planar (as seen in FIG. 2). The elastic material 120 pulls the interior surface of the first member 111 against the interior surface of the second member 112. Where a tube 190 of material is placed between the planar interior surfaces of the first member 111 and the second member 112, the elastic material 120 applies pressure to the tube 190. In various embodiments, the amount of pressure exerted by the elastic material 120 is selectively adjusted to conform to the needs of the user. In one embodiment, the pressure exerted by the elastic material 120 is not enough to squeeze material out of the tube 190 but is enough to prevent the tube 190 from returning to an expanded configuration. In this manner, a user is able to squeeze the tube 190 between the first member 111 and the second member 112 to dispense material from inside the tube 190 and maintain the tube 190 in the squeezed configuration.

The collar 130 is disposed orthogonally to, and connecting, the top end 151 of the first member 111 and the top end 152 of the second member 112. In the shown embodiment, the collar 130 is connected to the top end 151 of the first member 111 and the top end of the second member 112 by an elastic material. In another embodiment, the collar 130 is connected to the top end 151 of the first member 111 and the top end of the second member 112 by a flexible material. The collar remains connected to the first member 111 and the second member 112 when the tube squeezing device is fully compressed, when the tube squeezing device is fully expanded, and all configurations in between. The collar 130 further comprises an aperture 131. The aperture 131 is sized to receive a neck 191 of a tube 190 therethrough. In this manner, a tube 190 of material is inserted between the first member 111 and the second member 112 such that the neck 191 of the tube 190 passes through the collar 130 and the neck 191 extends through the aperture 131. Where the tube 190 incorporates a removable cap, the cap is able to be removed from the tube 190 prior to insertion of the tube 190 into the tube squeezing device and reattached to the neck 191 of the tube 190 once the neck 191 has passed through the aperture 131. In this manner, the tube 190 of material is further secured to the tube squeezing device.

Referring now to FIG. 2 there is shown a rear view of an embodiment of the tube squeezing device in an open and a partially closed configuration. The tube squeezing device has an open configuration, where the elastic material 120 is expanded and the first member 111 and second member 112 are separated. At least one pin 201 is pivotally disposed on the interior surface of the first member 111 at the bottom end 155. In the embodiment shown in FIG. 2, two pins 201 are disposed, one on the first side 161 of the first member 111 and the second on a second side 261 of the first member 111. The pins 201 pivot from a horizontal position, in parallel to the planar surface of the members, to a vertical position, perpendicular to the planar surface of the members. Where the pins 201 are in a vertical position, the pins 201 hold the members apart. At least one channel 220 is disposed along a width of the interior surface 210 of the first member 111 and along a width of the interior surface 210 of the second member 112 at the bottom ends thereof. The at least one channel 220 is sized to receive a length of the at least one pin 201. In one embodiment, the channel 220 disposed on the first member 111 aligns with the channel 220 disposed on the second member 112. In such an embodiment, the channels 220 together encapsulate the at least one pin 201. In some embodiments with multiple pins 201, a single channel 220 houses a single pin 201. In the shown embodiments, two channels 220 are parallel to each other, where one channel is disposed closer to the bottom end and the other channel is disposed closer to the top end. In such an embodiment, two pins 201 are able to pivot and reside in separate channels 220 such that the pins 201 do not interfere with each other (as shown in FIG. 3).

Figure 3:
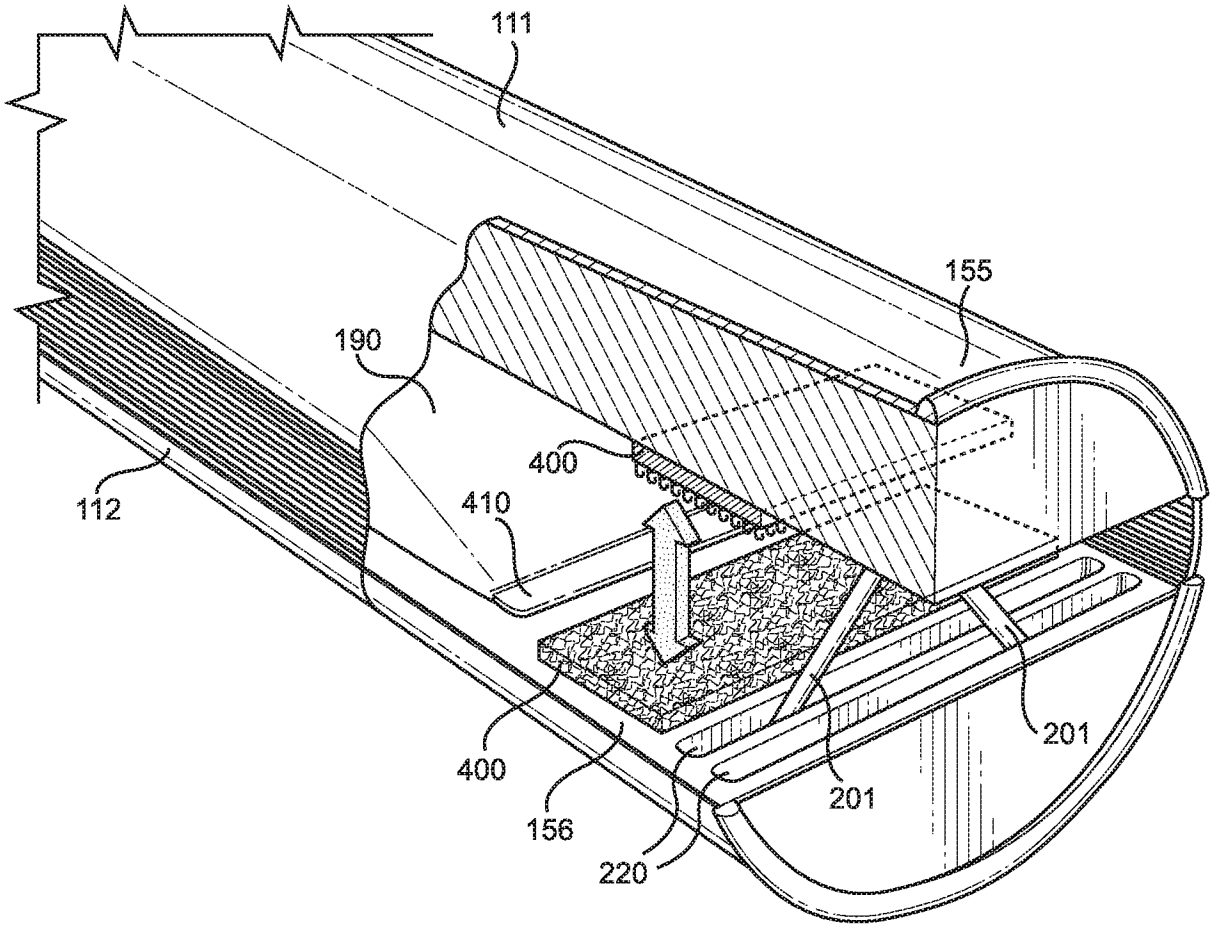
FIG. 3 shows an interior perspective view of an embodiment of the tube squeezing device with a focus on the fastener.

Referring now to FIG. 3, there is shown an interior perspective view of an embodiment of the tube squeezing device with a focus on the fastener. The tube squeezing device includes the fastener 400 disposed on opposing bottom ends 155, 156 of the first member 111 and the second member 112. In the shown embodiment, the fastener 400 is complementary hook and loop fasteners disposed in a manner such that the opposing materials of the hook and loop fastener line up and mesh with each other when the tube squeezing device is in a closed configuration. In such an embodiment, the fastener 400 is disposed along the interior surface at the bottom ends 155, 156 of the first member 111 and the second member 112. It should be understood by one of ordinary skill in the art that the fastener 400 can comprise a zipper, a button with a receiving slot, a complementary snap, or similar mechanisms for fastening the first member 111 to the second member 112.

In the shown embodiment, the fastener 400 is disposed adjacent to the channels 220. Further, in the shown embodiment, the fastener 400 is disposed between the tail end 410 of the tube 190 and the channels 220. In such an embodiment, the fastener 400 closes and secures the bottom ends 155, 156 of the first member 111 and the second member 112 together, thereby keeping the tube 190 between the planar inner surfaces of the first member 111 and the second member 112 when pressure is applied. When the fastener 400 is engaged, the tail end 410 of the tube 190 is prevented from sliding out from between the first member 111 and the second member 112.

In use, the bottom ends of a first member and a second member are separated. In the embodiments with pins and channels, the pins are rotated to a vertical position to hold the first member and the second member apart. A cap of a tube is removed, and a neck of the tube is passed through a collar and an aperture of the tube squeezing device. The cap is replaced to secure the tube between the first member and the second member. A fastener is engaged that keeps the tube between interior planar surfaces of the first member and the second member. In embodiments with pins and channels, the pins are rotated to a horizontal position and reside within the channels. A user removes the cap of the tube when ready to dispense a material inside the tube. The user squeezes the tube squeezing device which compresses the interior surfaces of the first member and the second member against the tube, thereby forcing material out of the tube through the neck of the tube. An elastic material connecting the first member to the second member keeps pressure against the tube such that the tube does not revert back to its original configuration. In this manner, a user is able to utilize a tube squeezing device to progressively squeeze material out of the tube and minimize waste.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A tube squeezing device, comprising:

a body having a first member, a second member, at least one elastic material, a collar, and a fastener;

the first member and the second member each having a top end and a bottom end, an interior surface and an exterior surface;

wherein the interior surface is planar;

a first piece of the elastic material of the at least one elastic material connecting a first side of the first member to a first side of the second member;

a second piece of the elastic material of the at least one elastic material connecting a second side of the first member to a second side of the second member;

the first piece of elastic material disposed along a length of the first side of the first member and along a length of the first side of the second member, the first piece of elastic material running from the top end to the bottom end of each side;

the second piece of elastic material disposed along a length of the second side of the first member and along a length of the second side of the second member, the second piece of elastic material running from the top end to the bottom end of each side;

the collar further comprising an aperture;

the aperture sized to receive a neck of a tube therethrough;

the fastener disposed on the bottom ends of the first member and the second member;

at least one pin pivotally disposed on the interior surface of the first member at the bottom end;

at least one channel disposed along a width of the interior surface of the first member and along a width of the interior surface of the second member at the bottom ends thereof;

the at least one channel sized to receive a length of the at least one pin.

2. The tube squeezing device of claim 1, wherein the first member and the second member are comprised of a flexible material.

3. The tube squeezing device of claim 1, wherein the first member and the second member are comprised of a waterproof material.

4. The tube squeezing device of claim 1, wherein the first member and the second member further comprise a contour that mimics a contour of the tube received therein.

5. The tube squeezing device of claim 1, wherein a raised texture is disposed on the exterior surface of the first member and the second member.

6. The tube squeezing device of claim 1, wherein the elastic material is spandex.

7. The tube squeezing device of claim 1, wherein the first member and the second member each have an inward taper such that the bottom ends of the first member and the second member are wider than the top ends thereof.

8. The tube squeezing device of claim 1, wherein the elastic material folds upon itself in an accordion fashion.

9. The tube squeezing device of claim 1, wherein the fastener is disposed along the interior surface at the bottom ends of the first member and the second member.

* * * * *